US006772963B2

(12) United States Patent
Neretti et al.

(10) Patent No.: US 6,772,963 B2
(45) Date of Patent: Aug. 10, 2004

(54) FUEL INJECTOR WITH A PIEZOELECTRIC ACTUATOR HOUSED IN AN INSULATED CHAMBER

(75) Inventors: Massimo Neretti, San Lazzaro Di Savena (IT); Michele Petrone, San Lazzaro Di Savena (IT); Andrea Ricci, San Michele (IT); Cecilia Lamberti, Bologna (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 0 days.

(21) Appl. No.: 10/139,984

(22) Filed: May 7, 2002

(65) Prior Publication Data

US 2003/0006299 A1 Jan. 9, 2003

(30) Foreign Application Priority Data

May 8, 2001 (IT) ..... BO2001A000279

(51) Int. Cl.[7] ..... F02M 47/02

(52) U.S. Cl. ..... 239/102.2; 239/533.1; 239/533.2; 239/533.3

(58) Field of Search ..... 239/533.2, 102.2, 239/533.3, 533.1

(56) References Cited

U.S. PATENT DOCUMENTS 4,284,263 A * 8/1981 Newcomb ..... 251/129
4,823,756 A * 4/1989 Ziejewski et al. ..... 123/531
5,740,969 A * 4/1998 Hoffmann et al. ..... 239/533.2
6,296,199 B1 * 10/2001 Noller et al. ..... 239/533.12
6,302,333 B1 * 10/2001 Hoffmann et al. ..... 239/88
6,435,430 B1 * 8/2002 Ruehle et al. ..... 239/585.4
6,467,460 B1 10/2002 Stier ..... 123/498
2002/0163282 A1 11/2002 Heinz ..... 310/328

FOREIGN PATENT DOCUMENTS

| | | |
|---|---|---|
| DE | 198 56 202 | 6/2000 |
| DE | 199 09 451 | 9/2000 |
| DE | 199 12 665 | 9/2000 |
| JP | 2000/277822 | 10/2000 |
| WO | WO 00/57049 | 9/2000 |
| WO | WO 00/60259 | 10/2000 |

OTHER PUBLICATIONS

Tailored Properties, available at: http://www.bekaert.com/composites/p_tailored_constr.htm.*

* cited by examiner

*Primary Examiner*—Gregory L. Huson
*Assistant Examiner*—Azadeh Kokabi
(74) *Attorney, Agent, or Firm*—Baker & Daniels

(57) ABSTRACT

A fuel injector having a piezoelectric actuator, which activates a shutter to move the shutter in a work direction between a closed position and an open position; the piezoelectric actuator is housed inside a casing having an inner chamber insulated from the fuel, and an outer surface wet by the fuel.

14 Claims, 4 Drawing Sheets

FUEL INJECTOR WITH A PIEZOELECTRIC ACTUATOR HOUSED IN AN INSULATED CHAMBER

The present invention relates to a fuel injector with a piezoelectric actuator.

BACKGROUND OF THE INVENTION

Fuel injectors with a piezoelectric actuator, i.e. for moving a shutter between a closed position and an open position, have been known for some years.

During operation, the piezoelectric actuator develops a certain amount of heat which, in steady operating conditions, produces a relatively high increase in its operating temperature, thus impairing its working life. To eliminate the above drawbacks, it has been proposed, e.g. as described in Patent Applications DE19909451 and DE19856202, to provide a cooling circuit for subjecting the injector casing to a continuous stream of cooling fluid (typically air or water). Such a solution, however, is relatively expensive and complicated, by requiring a cooling circuit for each injector.

SUMMARY OF THE INVENTION

It is an object of the present invention to provide a fuel injector with a piezoelectric actuator, designed to eliminate the aforementioned drawbacks, and which, in particular, is cheap and easy to produce.

According to the present invention, there is provided a fuel injector with a piezoelectric actuator, as claimed in claim 1.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
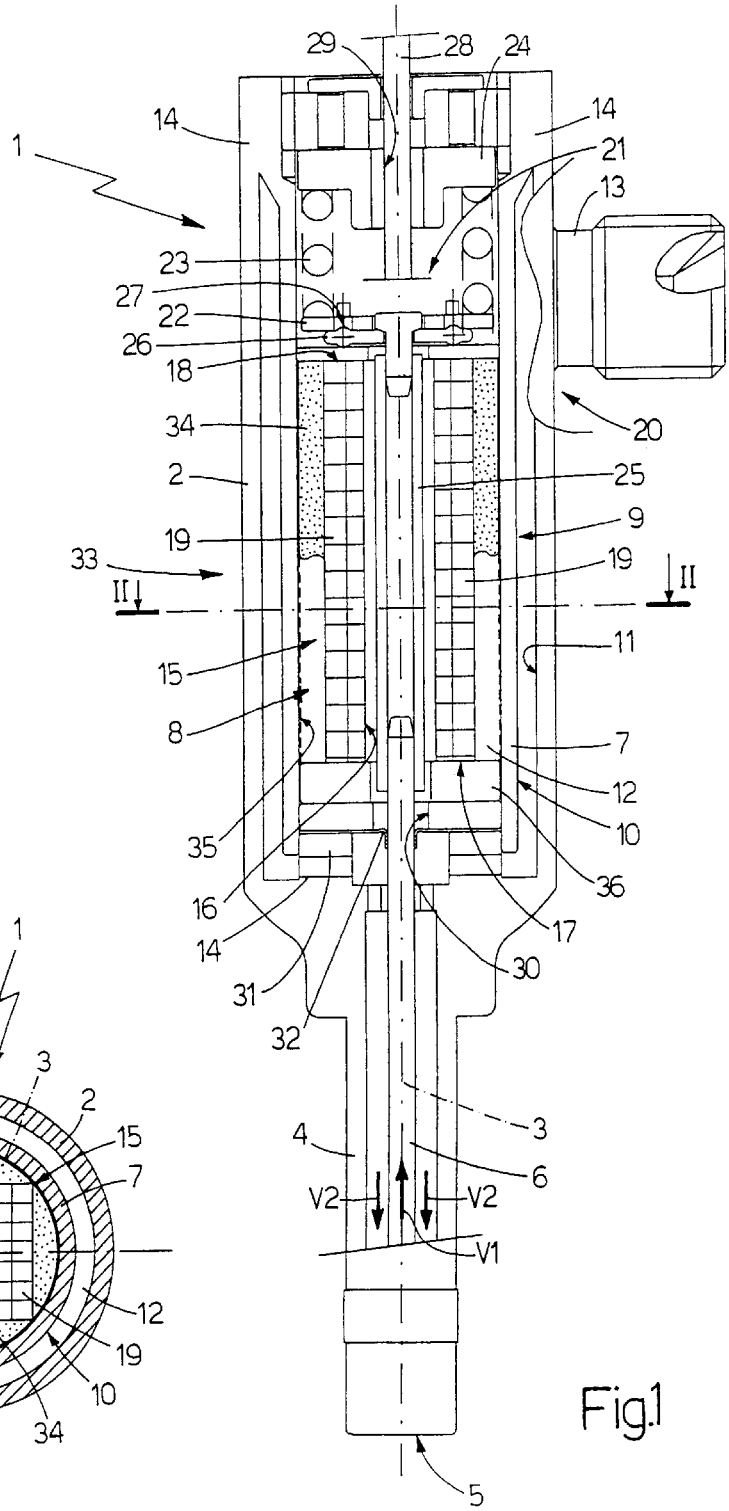
FIG. 1 shows a schematic, partly sectioned side view of a fuel injector in accordance with the present invention.
Figure 2:
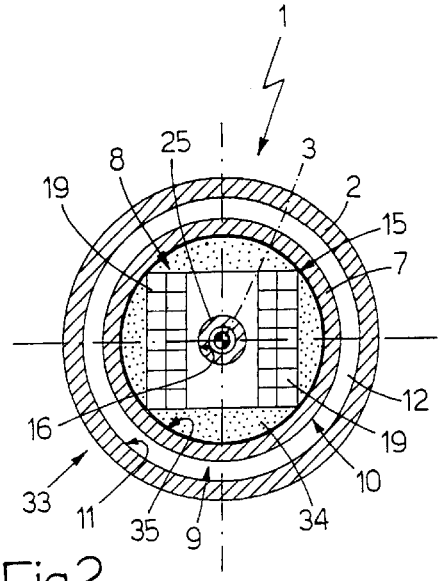
FIG. 2 shows a section along line II—II, and with parts removed for clarity, of the FIG. 1 injector.

Number 1 in FIGS. 1 and 2 indicates as a whole a fuel injector comprising a substantially cylindrical, circular-section casing 2 having a central axis 3 of symmetry. A cylindrical tubular injection conduit 4 is connected to the bottom end of casing 2, and terminates with an injection opening 5 regulated by a shutter 6 movable, along axis 3, between a closed position and an open position. A cylindrical, circular-section casing 7 is housed, coaxially with axis 3, inside casing 2, and has an inner chamber 8 housing a piezoelectric actuator 9 for activating shutter 6, i.e. for moving shutter 6 between said closed and open position.

Casing 7 is smaller in diameter, i.e. in size crosswise to axis 3, than casing 2, so as to define, between the outer lateral surface 10 of casing 7 and the inner lateral surface 11 of casing 2, an annular channel 12, along which fuel flows freely to the inlet of injection conduit 4 in a direction parallel to axis 3. More specifically, fuel is supplied under pressure to a top portion of annular channel 12 along a supply conduit 13 terminating inside casing 2.

Casing 7 is connected integrally to casing 2 by contact portions 14 defined by welds or similar, so that casing 7 defines a fixed frame of piezoelectric actuator 9. Piezoelectric actuator 9 comprises an actuator body 15, which is made of piezoelectric material, is aligned along axis 3, has a central hole 16 aligned along axis 3, has a bottom base 17 located close to shutter 6 and secured to casing 7, and has a top base 18 opposite bottom base 17 and which slides freely along axis 3 with respect to casing 7.

As shown in FIGS. 1 and 2, actuator body 15 is defined by two elements 19 of piezoelectric material, which are physically separate and arranged symmetrically about central axis 3. In a different embodiment not shown, actuator body 15 is defined by a single tubular element of piezoelectric material coaxial with axis 3.

A mechanical transmission 20 is interposed between the movable top base 18 and shutter 6, and has a movable assembly 21 positioned contacting top base 18 and connected rigidly to shutter 6. More specifically, movable assembly 21 comprises a plate 22, which is crosswise to axis 3, rests on top base 18, and is held resting on top base 18 by the pressure exerted along axis 3 by a spring 23 compressed between plate 22 and a top portion 24 of casing 7. A rod 25 is integral with plate 22, is housed, along axis 3, inside hole 16, and is connected rigidly to shutter 6.

An annular body 26 is interposed between plate 22 and top base 18, and has spherical contact surfaces 27, so that plate 22 floats with respect to base 18 and is free to oscillate slightly about an axis perpendicular to axis 3. Such oscillation is necessary to enable plate 22 to absorb—with no strain and therefore with no fatigue failure—any difference in expansion of elements 19 of piezoelectric material.

To drive actuator body 15, this is supplied with voltage by an electric cable 28 inserted through a hole 29 in top portion 24 of casing 7, through the central portion of spring 23, and through a hole (not shown) in plate 22. Electric cable 28 is inserted through the hole (not shown) in plate 22 with a certain amount of slack to allow plate 22 to move along axis 3 with respect to electric cable 28.

In actual use, when actuator body 15 is de-energized, i.e. is not subjected to an electric field, shutter 6 is set to said closed position in which it is pushed downwards along axis 3 by the pressure exerted by spring 23 and transmitted to shutter 6 by plate 22 and rod 25.

When energized, i.e. subjected to an electric field, actuator body 15 expands along axis 3, so that bottom base 17, being secured to casing 7, remains stationary, and top base 18 moves upwards along axis 3; which upward movement is transmitted to shutter 6 by plate 22 and rod 25, so as to move shutter 6, along axis 3, from the closed position to the open position.

Shutter 6 therefore moves along axis 3 from the closed to the open position in a direction V1 opposite the direction V2 in which fuel flows from supply conduit 13. To move from the closed to the open position, shutter 6 therefore moves inwards of supply conduit 13 into a configuration which reduces fouling, and therefore any impairment in efficiency, of injector 1.

Inner chamber 8 of casing 7 is formed so as to be insulated from the fuel; for which purpose, the outer lateral surface 10 of casing 7 is continuous with no openings, and the hole 30 formed in the bottom portion 31 of casing 7 to connect shutter 6 and rod 25 is fitted with a deformable sealing member 32.

Casing 7 is made of sheet metal with a high heat transmission coefficient, and comprises exchange means 33 for enhancing heat exchange between the fuel and piezoelectric actuator 9.

As shown in FIGS. 1 and 2, actuator body 15 is smaller than chamber 8; and exchange means 33 comprise a number of transmission bodies 34 made of heat-conducting material, and which are shaped and sized to fit between actuator body 15 and an inner lateral surface 35 of casing 7 to enhance heat transmission between actuator body 15 and casing 7. More specifically, each transmission body 34 is positioned contacting both actuator body 15 and inner lateral surface 35 of casing 7.

In an embodiment not shown, exchange means 33 also comprise fins on the fuel-swept outer lateral surface 10 of casing 7.

Piezoelectric actuator 9 is therefore housed inside chamber 8, which is insulated from the fuel, while fuel flows over outer lateral surface 10. Such a configuration is particularly advantageous by isolating piezoelectric actuator 9 from the fuel, and so protecting it against corrosion and fouling by the fuel, and by also providing, in a straightforward, low-cost manner, for continuously cooling piezoelectric actuator 9 by transmitting to the fuel flowing over outer lateral surface 10 the heat produced by piezoelectric actuator 9 inside chamber 8.

Transmission bodies 34 enhance heat transmission from piezoelectric actuator 9 to casing 7, and also fill the gaps in chamber 8 to ensure correct positioning of piezoelectric actuator 9 inside chamber 8.

In a preferred embodiment, injector 1 comprises at least one compensating member 36, the thermal expansion of which compensates for the different thermal expansions of actuator body 15 and mechanical transmission 20. In other words, by virtue of the combined effect of its size and thermal expansion coefficient (positive or negative), compensating member 36 expands thermally to compensate as a whole for the different thermal expansions of actuator body 15 and mechanical transmission 20.

Compensating member 36 may be integrated in casing 7, may be interposed between casing 7 and actuator body 15 (as shown in FIG. 1), or may be integrated in movable assembly 21.

In a preferred embodiment, compensating member 36 is made of metal with a low thermal expansion coefficient, in particular, INVAR.

Figure 3:
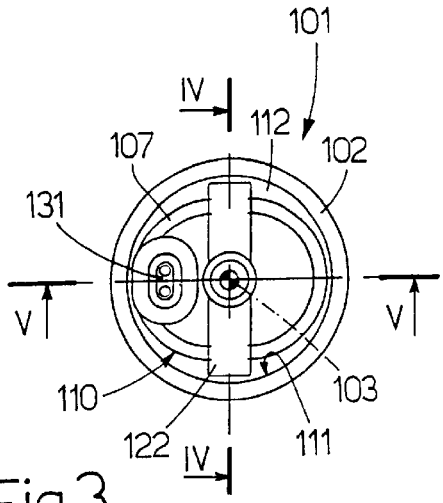
FIG. 3 shows a schematic plan view in section of a further embodiment of a fuel injector in accordance with the present invention.
Figure 5:
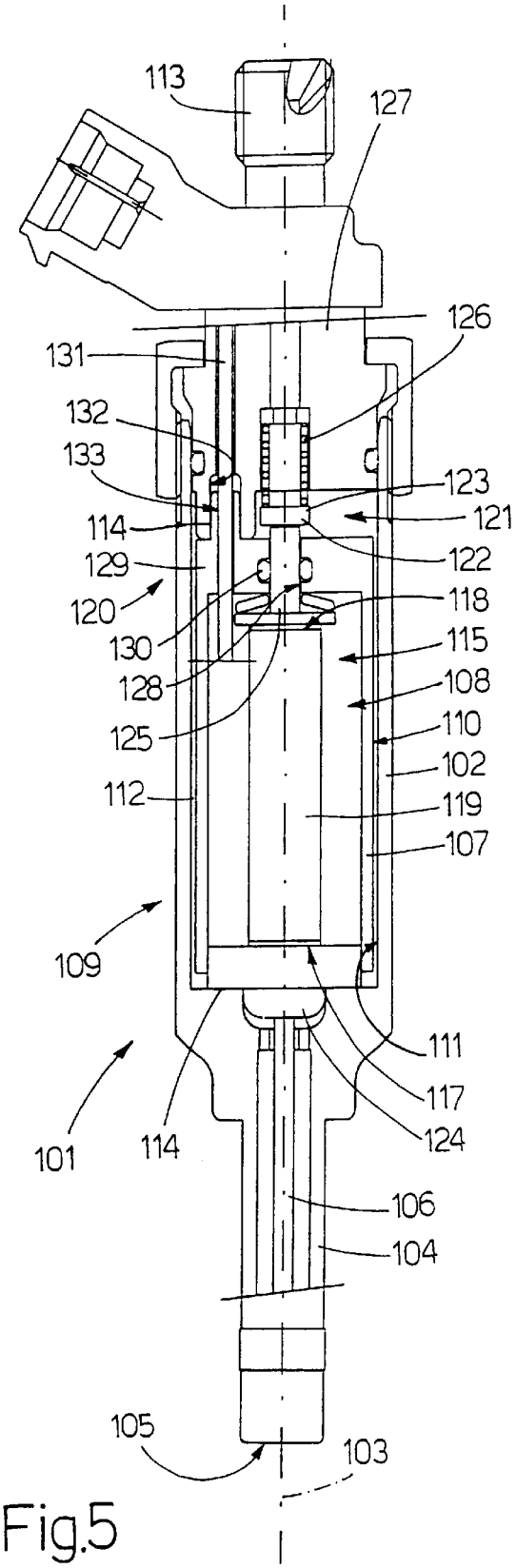
FIG. 5 shows a partial section along line V—V of the FIG. 3 injector.
Figure 4:
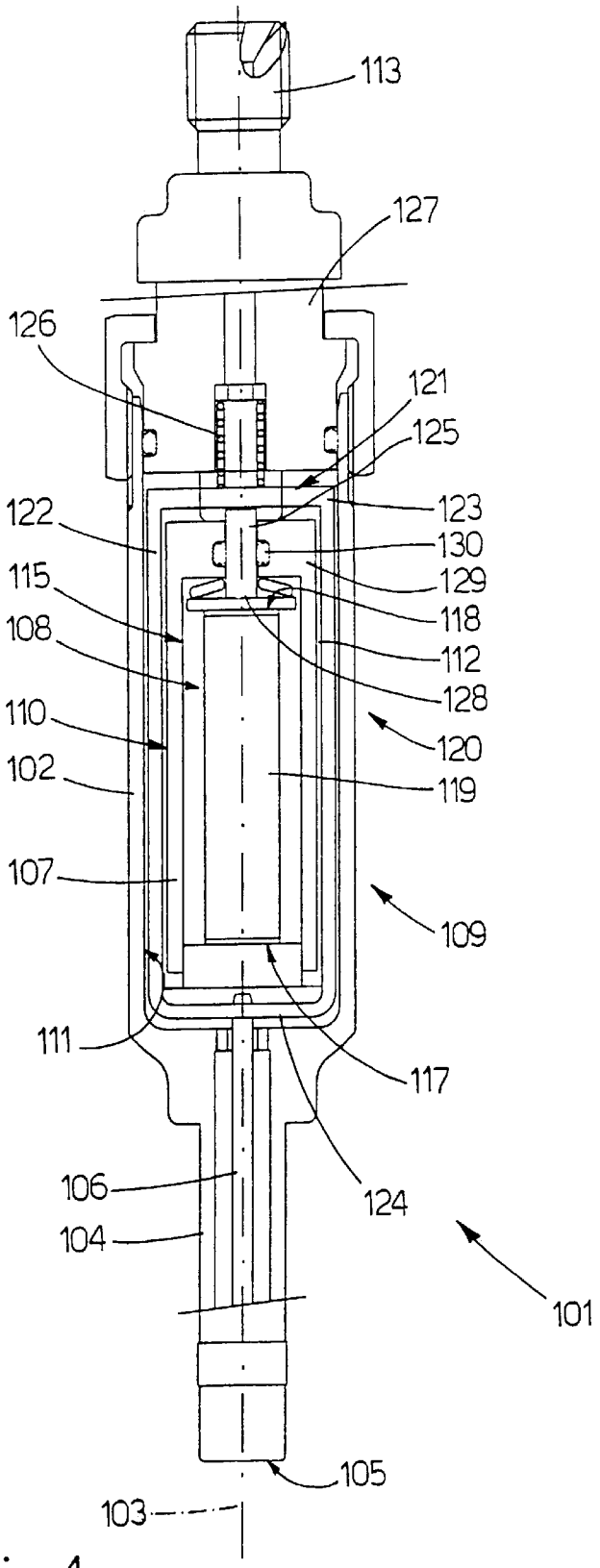
FIG. 4 shows a partial section along line IV—IV of the FIG. 3 injector.

Number 101 in FIGS. 3, 4 and 5 indicates as a whole a fuel injector comprising a substantially cylindrical, circular-section casing 102 having a central axis 103 of symmetry. A cylindrical tubular injection conduit 104 is connected to the bottom end of casing 102, and terminates with an injection opening 105 regulated by a shutter 106 movable, along axis 103, between a closed position and an open position. A cylindrical, oval-section casing 107 is housed, coaxially with axis 103, inside casing 102, and has an inner chamber 108 housing a piezoelectric actuator 109 for activating shutter 106, i.e. for moving shutter 106 between said closed and open position.

Casing 107 is smaller, crosswise to axis 103, than casing 102, so as to define, between the outer lateral surface 110 of casing 107 and the inner lateral surface 111 of casing 102, an annular channel 112, along which fuel flows freely to the inlet of injection conduit 104 in a direction parallel to axis 103. More specifically, fuel is supplied under pressure to a top portion of annular channel 112 along a supply conduit 113 terminating inside casing 102.

Casing 107 is connected integrally to casing 102 by contact portions 114 defined by welds or similar, so that casing 107 defines a fixed frame of piezoelectric actuator 109. Piezoelectric actuator 109 comprises an actuator body 115, which is made of piezoelectric material, is aligned along axis 103, has a bottom base 117 located close to shutter 106 and secured to casing 107, and has a top base 118 opposite bottom base 117 and which slides freely along axis 103 with respect to casing 107. Actuator body 115 is defined by one element 119 made of piezoelectric material and coaxial with central axis 103.

A mechanical transmission 120 is interposed between the movable top base 118 and shutter 106, and has a movable assembly 121 positioned contacting top base 118 and connected rigidly to shutter 106. More specifically, movable assembly 121 comprises an annular, substantially rectangular member 122, which is movable along axis 3, surrounds actuator body 115 and casing 107, and has a top transverse side 123 contacting top base 118, and a transverse side 124 opposite transverse side 123 and connected rigidly to shutter 106.

More specifically, annular member 122 rests on top base 118 via the interposition of a cylindrical body 125, and is held resting on top base 118 by the pressure exerted along axis 103 by a spring 126 compressed between top transverse side 123 and a top portion 127 of casing 102. Cylindrical body 125 is fitted through a hole 128 in the top portion 129 of casing 107, and is connected to hole 128 by a sealing member 130. To drive actuator body 115, this is supplied with voltage by an electric cable 131 inserted through a hole 132 in casing 102, and through a hole 133 formed in casing 107 and connected in fluidtight manner to hole 132. In actual use, when actuator body 115 is de-energized, i.e. is not subjected to an electric field, shutter 106 is set to said closed position in which it is pushed downwards along axis 103 by the pressure exerted by spring 126 and transmitted to shutter 106 by annular member 122.

When energized, i.e. subjected to an electric field, actuator body 115 expands along axis 103, so that bottom base 117, being secured to casing 107, remains stationary, and top base 118 moves upwards along axis 103; which upward movement is transmitted to shutter 106 by cylindrical body 125 and annular member 122, so as to move shutter 106, along axis 103, from the closed position to the open position.

Figure 6:
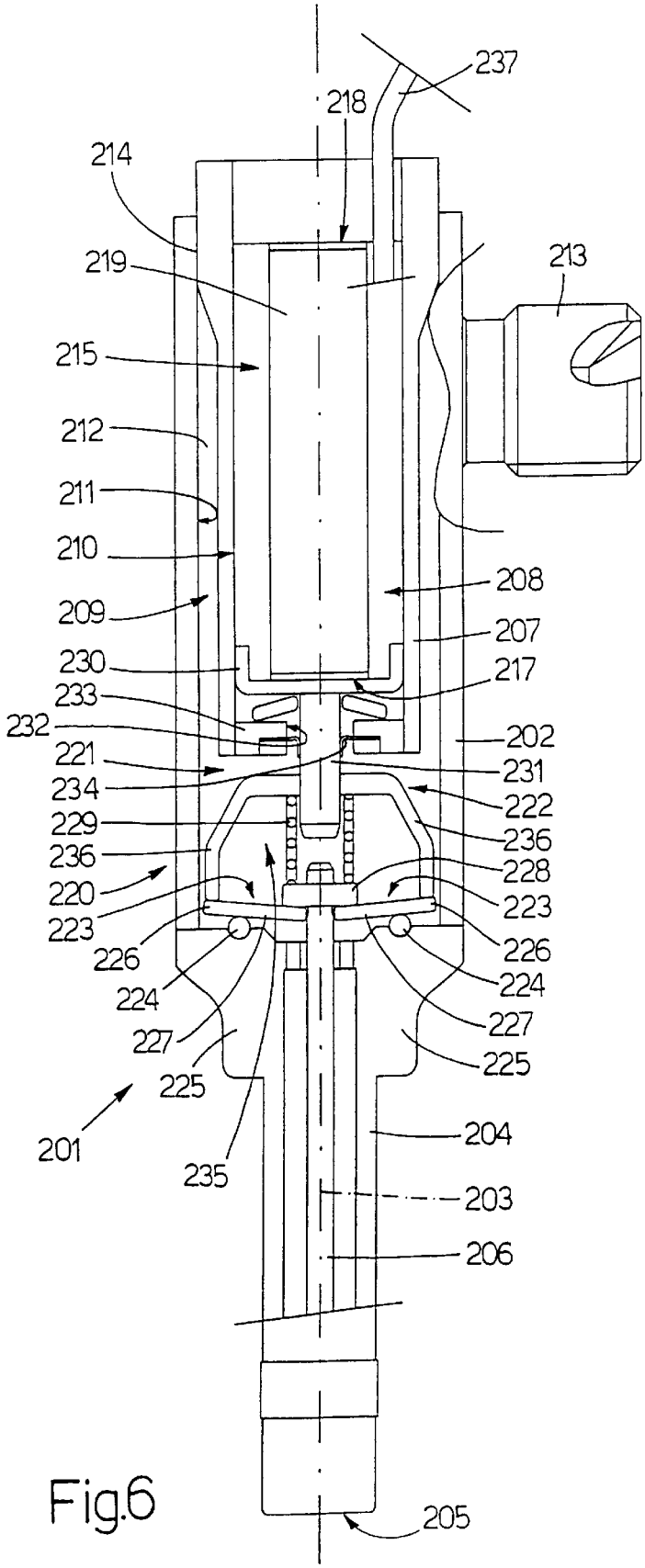
FIG. 6 shows a schematic, partly sectioned side view of a further embodiment of a fuel injector in accordance with the present invention.

Number 201 in FIG. 6 indicates as a whole a fuel injector comprising a substantially cylindrical, circular-section casing 202 having a central axis 203 of symmetry. A cylindrical tubular injection conduit 204 is connected to the bottom end of casing 202, and terminates with an injection opening 205 regulated by a shutter 206 movable, along axis 203, between a closed position and an open position. A cylindrical, circular-section casing 207 is housed, coaxially with axis 203, inside casing 202, and has an inner chamber 208 housing a piezoelectric actuator 209 for activating shutter 206, i.e. for moving shutter 206 between said closed and open position.

Casing 207 is smaller in diameter, i.e. in size crosswise to axis 203, than casing 202, so as to define, between the outer lateral surface 210 of casing 207 and the inner lateral surface 211 of casing 202, an annular channel 212, along which fuel flows freely to the inlet of injection conduit 204 in a direction parallel to axis 203. More specifically, fuel is supplied under pressure to a top portion of annular channel 212 along a supply conduit 213 terminating inside casing 202.

Casing 207 is connected integrally to casing 202 by contact portions 214 defined by welds or similar, so that casing 207 defines a fixed frame of piezoelectric actuator 209. Piezoelectric actuator 209 comprises an actuator body 215, which is made of piezoelectric material, is aligned along axis 203, has a bottom base 217 located close to shutter 206 and free to slide along axis 203 with respect to casing 207, and has a top base 118 opposite bottom base 217 and secured to casing 207. Actuator body 215 is defined by a single element 219 made of piezoelectric material and coaxial with central axis 203.

A mechanical transmission 220 is interposed between the movable bottom base 217 and shutter 206, and provides for inverting the direction of the movement produced by expansion of piezoelectric actuator 209 along axis 203, so that a first movement produced by expansion of piezoelectric actuator 209 along axis 203 corresponds to a second movement of shutter 106 along axis 203 and in the opposite direction to the first movement.

Mechanical transmission 220 comprises a movable assembly 221 secured to bottom base 217 and connected to shutter 206; and a rocker-arm, motion-inversion system 222 for converting a first movement, produced by expansion of piezoelectric actuator 209 along axis 203, into a second movement of shutter 206 along axis 203 and in the opposite direction to the first movement.

Motion-inversion system 222 comprises two rocker arms 223 located symmetrically on opposite sides of axis 203. Each rocker arm 223 rests on a respective fixed fulcrum 224 defined by a spherical body projecting from a bottom portion 225 of casing 202, and comprises an arm 226 contacting movable assembly 221, and an arm 227 contacting a mating member 228 integral with shutter 206.

Arms 226 and 227 of each rocker arm 223 rest on both movable assembly 221 and mating member 228, and are maintained in this position by the pressure exerted along axis 203 by a spring 229 compressed between movable assembly 221 and mating member 228.

More specifically, movable assembly 221 comprises a plate 230 crosswise to axis 203 and integral with bottom base 217; plate 230 is integral with a cylindrical body 231 extending through a hole 232 in a bottom portion 233 of casing 207, with the interposition of a sealing member 234; and body 231 supports a fork 235 having two symmetrical branches 236, each of which is maintained resting on the end of a respective arm 226. To drive actuator body 215, this is supplied with voltage by an electric cable 237.

In actual use, when actuator body 215 is de-energized, i.e. is not subjected to an electric field, shutter 206 is set to said closed position in which it is pushed downwards along axis 203 by the pressure exerted by spring 229.

When energized, i.e. subjected to an electric field, actuator body 215 expands along axis 203, so that top base 218, being secured to casing 207, remains stationary, and bottom base 217 moves downwards along axis 203; which downward movement is transmitted to shutter 206 by mechanical transmission 220, so as to move shutter 206, along axis 203, from the closed position to the open position.

Depending on the size ratio of arms 226 and 227 of each rocker arm 223, a given transmission ratio equal to, less than, or greater than 1 can be imparted to mechanical transmission 220. In FIG. 6, in particular, mechanical transmission 220 has an amplification factor which amplifies the movement produced by expansion of actuator body 15.

What is claimed is:

1. A fuel injector having a piezoelectric actuator (9; 109; 209); a first casing (7; 107; 207) housing the piezoelectric actuator (9; 109; 209); and a shutter (6; 106; 206) which is activated by the piezoelectric actuator (9; 109; 209) to move, in a work direction (3; 103; 203), between a closed position and an open position; the injector (1; 101; 201) being characterized in that the first casing (7; 107; 207) comprises an inner chamber (8; 108; 208) insulated from the fuel, housing the piezoelectric actuator (9; 109; 209), and having an outer surface (10; 110; 210) wet by the fuel; said shutter (6; 106; 206) being activated by the piezoelectric actuator (9; 109; 209) and regulating fuel supply flowing in said work direction (3; 103; 203); a mechanical transmission (20; 120; 220) being interposed between the piezoelectric actuator (9; 109; 209) and the shutter (6; 106; 206), so that expansion of the piezoelectric actuator (9; 109; 209) moves the shutter (6; 106; 206) from a closed position to an open position in the work direction (3; 103; 203) and in a sense (V1) opposite the fuel outflow sense (V2); said mechanical transmission (20; 120; 220) inverting the sense of the movement produced by expansion of the piezoelectric actuator (9; 109; 209) in said work direction (3; 103; 203), so that a first movement produced by expansion of the piezoelectric actuator (9; 109; 209) in the work direction (3; 103; 203) corresponds to a second movement of the shutter in the work direction (3; 103; 203) and in the opposite sense to said first movement.

2. An injector as claimed in claim 1, wherein said first casing (7; 107; 207) is made of metal material having a high heat transmission coefficient.

3. An injector as claimed in claim 1, wherein said first casing (7; 107; 207) is made of sheet metal.

4. An injector as claimed in claim 1, wherein said first casing (7; 107; 207) has exchange means (33) for enhancing heat exchange between said fuel and said piezoelectric actuator (9; 109; 209).

5. An injector as claimed in claim 4, wherein said piezoelectric actuator (9; 109; 209) is smaller than said chamber (8; 108; 208); said exchange means (33) comprising at least one transmission body (34) made of heat-conducting material and located between said piezoelectric actuator (9; 109; 209) and an inner surface (35) of said first casing (7; 107; 207) to enhance heat transmission between the piezoelectric actuator (9; 109; 209) and the first casing (7; 107; 207).

6. An injector as claimed in claim 5, wherein said transmission body (34) is positioned contacting both said piezoelectric actuator (9; 109; 209) and said inner surface (35) of said first casing (7; 107; 207).

7. An injector as claimed in claim 5, wherein said transmission body (34) provides for positioning said piezoelectric actuator (9; 109; 209) inside said chamber (8; 108; 208).

8. An injector as claimed in claim 1, wherein said first casing (7; 107; 207) is cylindrical, has a central axis parallel to said work direction (3; 103; 203), and has a cylindrical lateral surface (10; 110; 210) at least partly wet by the fuel.

9. An injector as claimed in claim 8, wherein said chamber (8; 208) has a circular section.

10. An injector as claimed in claim 8, wherein said chamber (108) has an oval section.

11. An injector as claimed in claim 8, and comprising a cylindrical second casing (2; 102; 202) having a central axis parallel to said work direction (3; 103; 203) and coaxial with the central axis of said first casing (7; 107; 207); the cylindrical second casing (2; 102; 202) housing the first casing (7; 107; 207) with a given clearance to permit fuel flow inside the gap (12; 112; 212) between the two casings (2, 7; 102, 107; 202, 207).

12. An injector as claimed in claim 11, wherein said second casing (102) comprises a supply conduit (113) for supplying said fuel, and which terminates over said first casing (107).

13. An injector as claimed in claim 11, wherein said second casing (2; 202) comprises a supply conduit (13; 213) for supplying said fuel, and which terminates laterally with respect to said first casing (7; 207).

14. An injector as claimed in claim 1, and comprising a movable member (25; 125; 231) connected mechanically to both said piezoelectric actuator (9; 109; 209) and said shutter (6; 106; 206) to transmit the movement of the piezoelectric actuator (9; 109; 209) to the shutter (6; 106; 206); said movable member (25; 125; 231) being fitted through said first casing (7; 107; 207) with the interposition of a deformable sealing member (32; 130; 234).

* * * * *